United States Patent [19]

Rimai et al.

[11] Patent Number: 5,006,897

[45] Date of Patent: Apr. 9, 1991

[54] DETERMINATION OF CHARGE-TO-MASS RATIO

[75] Inventors: Donald S. Rimai, Webster; Joseph F. Laukaitis; Mark Zaretsky, both of Rochester; Bruno Primerano, Webster, all of N.Y.

[73] Assignee: Eastman Kodak Company, Rochester, N.Y.

[21] Appl. No.: 546,983

[22] Filed: Jul. 2, 1990

[51] Int. Cl.[5] ..... G03G 21/00

[52] U.S. Cl. ..... 355/246; 118/653; 118/690; 355/208

[58] Field of Search ..... 355/208, 245, 246, 251, 355/253; 118/653, 689, 690, 656, 657, 658; 73/580, DIG. 4

[56] References Cited

U.S. PATENT DOCUMENTS

| | | | |
|---|---|---|---|
| 3,821,938 | 7/1974 | Bacon et al. | 118/690 |
| 3,844,174 | 10/1974 | Chabre | 74/432 PS |
| 4,026,643 | 5/1977 | Bergman | 355/246 |
| 4,314,242 | 2/1982 | Kuru et al. | 340/617 |
| 4,425,871 | 1/1984 | Martin | 118/664 |
| 4,524,088 | 6/1985 | Fagen, Jr. et al. | 355/246 |
| 4,615,606 | 10/1986 | Nishikawa | 355/253 X |
| 4,626,096 | 12/1986 | Ohtsuka et al. | 355/246 X |
| 4,646,679 | 3/1987 | Ohno et al. | 118/691 |

*Primary Examiner*—A. T. Grimley
*Assistant Examiner*—Robert Beatty
*Attorney, Agent, or Firm*—Milton S. Sales

[57] ABSTRACT

In electrostatographic apparatus, the ratio of toner particle electrostatic charge-to-toner particle mass and the development rate are determined by providing a piezo device positioned to interact with toner particles. The device is periodically electrically biased to attract toner particles, and the frequency shift of the piezo device due to the mass of attracted toner particles is detected. The electrostatic charge buildup on the electrode due to the attracted toner particles is detected to determine the mass of toner. The potential on the device may be changed periodically from a potential which attracts toner to a potential which repels toner to clean the device.

11 Claims, 2 Drawing Sheets

$$2\omega^2 = \left(\frac{K}{M}+\frac{k}{M}+\frac{k}{m}\right) \pm \left[\left(\frac{K}{m}+\frac{k}{M}+\frac{k}{m}\right)^2 - 4\,\frac{K}{M}\,\frac{k}{m}\right]^{1/2}$$

DETERMINATION OF CHARGE-TO-MASS RATIO

CROSS-REFERENCE TO RELATED APPLICATION

Reference is made to commonly assigned, co-pending U.S. patent application Ser. No. 473,530 filed on Feb. 1, 1990, in the name of J. Laukaitis.

BACKGROUND OF THE INVENTION

1. Technical Field

This invention relates generally to the measurement of the ratio of toner particle electrostatic charge to toner particle mass in electrostatographic reproduction apparatus such as copiers and/or printers.

2. Background Art

The electrostatographic process is controllable by means of various parameters such as primary voltage $V_0$, exposure $E_0$, development bias $V_b$, and the concentration of toner particles in the development mixture. Another important parameter in the development of latent electrostatic images is the ratio of toner particle electrostatic charge-to-toner particle mass.

Several factors influence the charge-to-mass ratio, such as for example, relative humidity, toner concentration, chemical contamination, developer mixture aging, etc. Developer mixture aging can result from larger toner particles tending to develop easier than smaller particles, leading to a decrease in average toner particle size and greater charge-to-mass ratio.

Changes in charge-to-mass ratio results in a tendency toward decreased toner density for a given difference in charge between the toner particles and the electrostatic image. Accordingly, it is desirable to monitor the charge-to-mass ratio so that other parameters can be adjusted to compensate for changes in the ratio. For example, feedback control can be used to adjust, say, the brush or photoconductor bias in response to changes in the charge-to-mass ratio and development rate.

U.S. Pat. No. 4,026,643, which issued to Bergman on May 31, 1977, discloses apparatus for measuring the charge-to-mass ratio by combining a measurement of the difference between the electrostatic charge on a photoconductor before and after development (proportional to the charge) with a measurement of a difference in optical reflectance in the presence and in the absence of charged toner particles (related to the toner mass). This system has the disadvantage that it must be calibrated for the optical reflectance of each toner color; and probably for each batch of the same color toner. In such devices, optical reflectance has to be calibrated for the optical reflectance of each type (color, etc.) toner used, and probably for each batch of the same toner types.

DISCLOSURE OF INVENTION

It is an object of the present invention to provide an improved apparatus and method for determination of the ratio of toner particle electrostatic charge-to-toner particle mass in electrostatographic apparatus.

It is another object of the present invention to provide a toner charge-to-mass monitor which gives improved performance over prior art monitors.

It is yet another object of the present invention to provide a monitor which simultaneously provides toner concentration, toner charge-to-mass, and development rate readings.

These and other objects of the present invention are attained by the provision of electrostatographic apparatus comprising a piezo device having an electrode capacitively coupled to another member and positioned to interact with toner particles used in the apparatus. The electrode is periodically electrically biased to attract toner particles, and the frequency shift of the piezo device due to the mass of attracted toner particles is detected. The potential on the electrode may be changed periodically from a potential which attracts toner to a potential which repels toner to clean the electrode.

In accordance with another feature of the present invention, the electrostatic charge buildup on the electrode due to the attracted toner particles is detected to determine the toner charge.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

This disclosure will be directed, in particular, to elements forming part of, or cooperating more directly with, apparatus in accordance with the present invention. It is to be understood that elements, components, and/or sub-components not specifically shown or described may take various forms well known to those skilled in the electrostatographic art.

Figure 1:
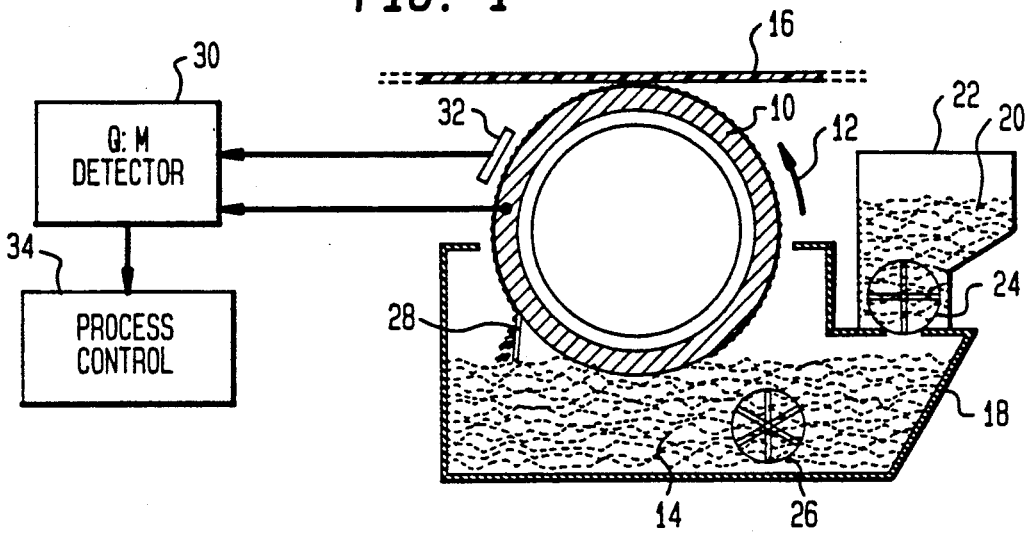
FIG. 1 illustrates an apparatus for determination of the ratio of toner particle electrostatic charge-to-toner particle mass in electrostatographic reproduction apparatus according to the present invention.

FIG. 1 is a schematic view of a magnetic brush-type development station of electrostatographic reproduction apparatus such as copiers and/or printers. The present invention applies to other types of development stations.

The development station includes a magnetic brush roller 10 rotatable in direction 12 to carry developer mixture 14 to a receiver member 16, such as a photoconductor of a copier or printer, for the purpose of developing latent electrostatic images on a surface of the receiver member as the member is driven past the development station. Magnetic brush roller 10 feeds two-component development mixture comprising carrier particles and toner particles from a hopper 18. The developer mixture is replenished by toner particles 20 from an enclosure 22 by augers, valves or gates 24 and 26 according to conventional practice. The portion of the developer mixture which is not transferred to receiver member 16 is removed from the magnetic brush roller by a skive 28; falling back into hopper 18.

An apparatus 30 for determination of the ratio of toner particle electrostatic charge-to-toner particle mass is positioned between the development region of roller 10 and skive 28. A probe 32 is positioned adjacent to brush roller 10. Apparatus 30 issues an appropriate signal to control predetermined process parameters, as indicated in a block 34.

Figure 2:
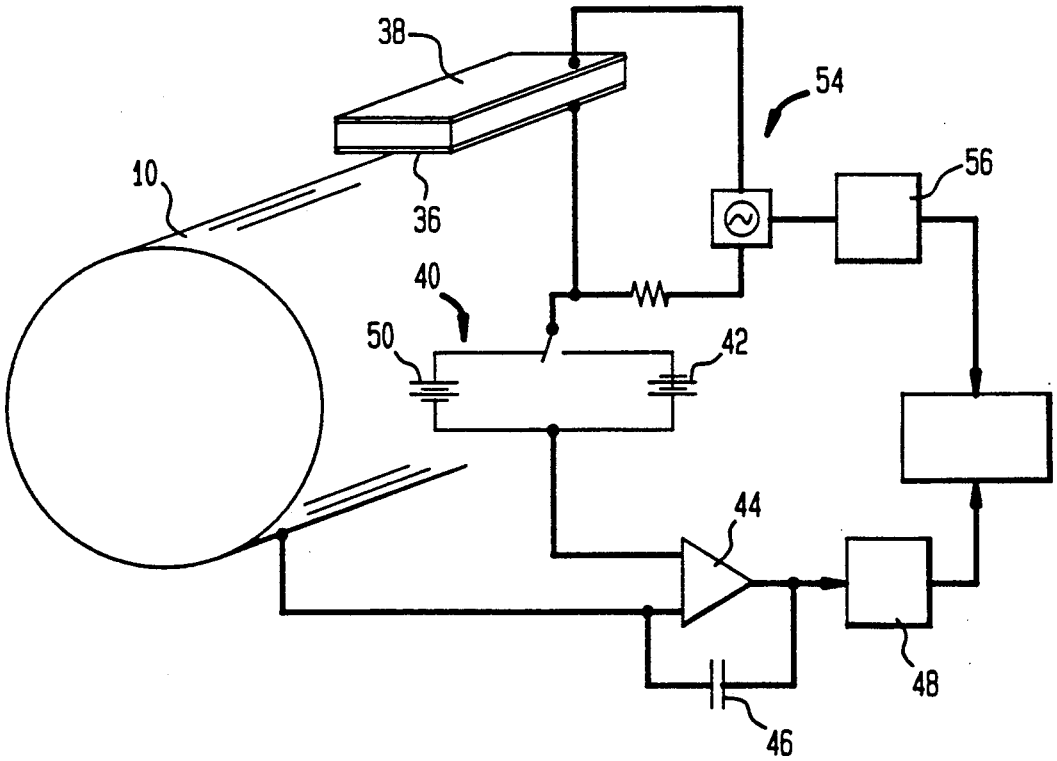
FIG. 2 is a rear perspective view of a portion of the apparatus of FIG. 1, showing details of the toner charge-to-mass monitor circuit.

Details of the probe construction are shown in FIG. 2. The probe includes an electrode 36 fabricated on a piezoelectric crystal resonator 38. Electrode 36 is one plate of a capacitive circuit, and roller 10 is the other plate, with the developer mixture positioned between the two plates acting as part of the dielectric of the capacitor. A close spacing, such as 0.020 inch, would normally be maintained between electrode 36 and roller 10.

By appropriately measuring the electrical characteristics of the capacitive circuit, the charge of toner particles on the developer mixture positioned between the two plates can be determined. A reversing power supply 40 can be switched from its illustrated position to connect a source 42 to the capacitive plates to start a transient condition, developing toner particles onto electrode 36. The transient response is measured and used as an indication of the toner charge built up on electrode 36. As will be explained, the transient detection can be in the form of an electrical current, voltage, time, or charge measurement indicative of the instantaneous state of the capacitor.

The charge across the capacitor is inputted to an operational amplifier 44 with a feedback loop capacitor 46 to integrate transient current to provide an input to an electrometer 48 for determining the charge laid down.

The power supply is reversed periodically during the operation of the development station so that transients occur each time a development potential is applied to electrode 36, as described in commonly assigned, copending U.S. patent application Ser. No. 473,530 filed on Feb. 1, 1990, in the name of J. Laukaitis. When reversing power supply 40 is returned to its illustrated switch position, a second source 50 is connected to electrode 36 to reverse power supply 40 to start a transient condition across capacitor 46. Operational amplifier 44 uses feedback capacitor 46 to form an integrating circuit which integrates the charging current existing between electrode 36 and roller 10.

Figures 3, 4:
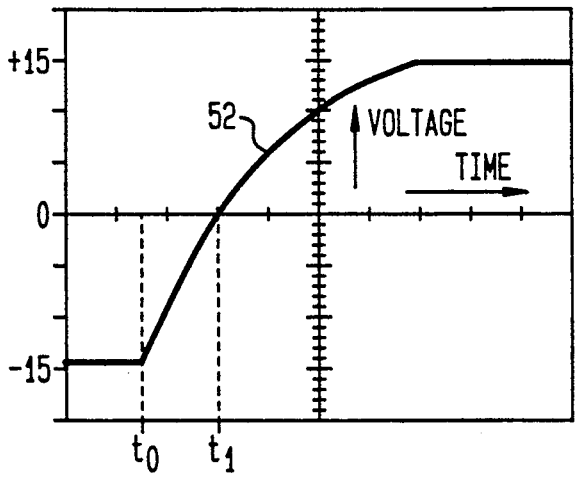
FIG. 3 is an oscillogram of a voltage-time relationship of a feature of the present invention.
FIG. 4 is an equation helpful in the understanding of the present invention.

FIG. 3 is an oscillogram of the voltage-time relationship for capacitor 46. Such a graph would be produced by connecting an oscilloscope to the output of amplifier 44. Assuming supply voltages of +15 volts and −15 volts for the operational amplifier, the voltage output as a function of time is indicated by the curve 52. The charging or developing potential is applied at time $t_0$. The time period for the output to reach a second, arbitrary voltage is measured as an indication of the development (mass transport) rate onto electrode 36. The second voltage has been selected as the zero cross-over for convenience and because the slope of output curve 52 is relatively constant in that range. Time $t_1$ occurs at the instant of cross-over, and the period $t_1-t_0$ is used as the indication of the development rate electrode 36.

As set forth above, electrode 36 is fabricated on a piezoelectric crystal resonator 38 to form probe 32. By detecting the change in the resonant frequency of the piezoelectric crystal, the mass of the toner particles can be determined.

In the preferred case of strong coupling of the toner to electrode 36, the resonator can be thought of as a mass M attached to a spring of force constant K, where K is determined from the appropriate elastic constants of the crystal. The resonate frequency of the oscillator is inversely proportional to its mass so that:

$$\omega_o^2 = K/M \tag{1}$$

It is noted that the ideal case of strong coupling between the toner and electrode 36 is not necessary for the operation of the device. So long as the oscillator frequency varies in a known manner with the toner mass, and the toner does not come off of the electrode as a result of the ultrasonic vibrations, the system will work.

If the mass m of toner particles deposited on the oscillator is assumed to be attached by a spring force constant k, the coupled oscillator system will now resonate at a new frequency $\omega$. Using Newton's equations, $\omega$ can be found in terms of k, m, K, and M according to the equation of FIG. 4.

In the limit of strong coupling between the toner particles and the oscillator crystal for the ideal case (i.e., K=k), the equation of FIG. 4 becomes:

$$2\omega^2 = K/(M+m) \tag{2}$$

Thus, it is shown that the oscillator frequency is a function of the toner mass on electrode 36. A discussion of the theory of the relationship between the resonate frequency and mass loading can be found in the *Journal of Applied Physics* 58(7); "A Sensitive New Method for the Determination of Adhesive Bonding Between a Particle and a Substrate"; G. L. Dybwad; Oct. 1, 1985; pp. 2789–2790.

The output of an oscillator circuit 54 is inputted to a frequency counter 56 to produce a signal characteristic of the mass of toner on electrode 36. Alternatively, the output of oscillator 54 can beat against a known frequency, and the resultant beat frequency may be fed to a frequency-to-voltage converter to produce a signal characteristic of the mass.

Now, the outputs of the charge measuring circuit and the resonance detection circuit are used to provide a charge-to-mass input signal for process controller operations. The information from the development rate circuit can also be used for process control. Moreover, the development of toner produces a current which is the product of the development rate and the charge-to-mass ratio. Since the charge giving rise to this current is carried by the toner, and since greater concentrations of toner in the development mixture will produce higher current flow, the toner concentration of the mixture can be determined using the features of the present invention described herein.

By the repeated reversing of the potential on electrode 36, cleaning voltages are applied at intervals. The toner particles are cleaned from the electrode by a repelling force. The particles return to roller 10 and are skived back to hopper 18.

The invention has been described in detail with particular reference to preferred embodiments thereof, but it will be understood that variations and modifications can be effected within the spirit and scope of the invention. For example, to block DC, electrode 36 can be coated with insulating material such as SiC, $SiO_2$, etc. The insulating material should not significantly tribocharge against the developer.

What is claimed is:

1. Electrostatographic apparatus comprising means for developing a latent electrostatic image by the application of toner particles, said apparatus comprising:

a piezo device having an electrode capacitively coupled to another member and positioned to interact with toner particles used in the apparatus;

means for periodically electrically biasing the electrode to attract toner particles; and means for detecting the frequency shift of the piezo device due to the mass of attracted toner particles.

2. Electrostatographic apparatus as set forth in claim 1 wherein said means for periodically electrically biasing the electrode to attract toner particles is adapted to periodically change the potential on the electrode from a potential which attracts toner to a potential which repels toner to periodically clean the electrode.

3. Electrostatographic apparatus comprising means for developing a latent electrostatic image by the application of toner particles, and means for measuring the ratio of toner particle electrostatic charge-to-toner particle mass, said measuring means comprising:

a piezo device having an electrode capacitively coupled to another member and positioned to interact with toner particles used in the apparatus;

means for periodically electrically biasing the electrode to attract toner particles;

means for detecting the electrostatic charge buildup on the electrode due to the attracted toner particles; and means for detecting the frequency shift of the piezo device due to the mass of attracted toner particles.

4. Electrostatographic apparatus with said measuring means as set forth in claim 3 wherein said electrostatic charge buildup detecting means and said frequency shift detecting means produce simultaneous signals which are used to produce a charge-to-mass signal.

5. Electrostatographic apparatus as set forth in claim 4 wherein said electrostatic charge buildup detecting means is adapted to measure the rate of said charge buildup.

6. Electrostatographic apparatus as set forth in claim 5 further comprising means, responsive to the measured rate of charge buildup, for determining the rate of toner mass deposition.

7. Electrostatographic apparatus as set forth in claim 6 wherein the determined rate of toner mass deposition and the charge-to-mass signal are used to determine toner concentration.

8. Electrostatographic apparatus with said measuring means as set forth in claim 3 wherein said means for periodically electrically biasing the electrode to attract toner particles is adapted to periodically change the potential on the electrode from a potential which attracts toner to a potential which repels toner to periodically clean the electrode.

9. Electrostatographic apparatus with (1) a plurality of adjustable process control parameters, (2) means for developing a latent electrostatic image by the application of toner particles, and (3) means for adjusting at least one of the process control parameters in accordance with a signal characteristic of the ratio of electrostatic charge-to-toner particle mass of toner particles applied to the latent image, said apparatus comprising:

a piezo device having an electrode capacitively coupled to another member and positioned to interact with toner particles used in the apparatus;

means for periodically electrically biasing the electrode to attract toner particles;

means for detecting the electrostatic charge buildup on the electrode due to the attracted toner particles;

means for detecting the frequency shift of the piezo device due to the mass of attracted toner particles; and means for producing a signal characteristic of the ratio of electrostatic charge-to-toner particle mass of toner particles.

10. Electrostatographic apparatus with said measuring means as set forth in claim 9 wherein said electrostatic charge buildup detecting means and said frequency shift detecting means produce simultaneous signals which are used to produce a charge-to-mass signal.

11. Electrostatographic apparatus with said measuring means as set forth in claim 9 wherein said means for periodically electrically biasing the electrode to attract toner particles is adapted to periodically change the potential on the electrode from a potential which attracts toner to a potential which repels toner to periodically clean the electrode.

* * * * *